US008884516B2

(12) United States Patent
Miller et al.

(10) Patent No.: US 8,884,516 B2
(45) Date of Patent: Nov. 11, 2014

(54) TRAVELING WAVE ELECTRON DEVICE WITH MEMBRANE-SUPPORTED SLOW WAVE CIRCUIT

(75) Inventors: Mark S. Miller, Salt Lake City, UT (US); Guillermo A. Oviedo Vela, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 835 days.

(21) Appl. No.: 12/986,744

(22) Filed: Jan. 7, 2011

(65) Prior Publication Data

US 2011/0169404 A1 Jul. 14, 2011

Related U.S. Application Data

(60) Provisional application No. 61/293,580, filed on Jan. 8, 2010.

(51) Int. Cl.

| | |
|---|---|
| ***H01J 25/34*** | (2006.01) |
| ***H01B 13/00*** | (2006.01) |
| ***H01J 23/24*** | (2006.01) |

(52) U.S. Cl.
CPC *H01J 23/24* (2013.01); *H01J 25/34* (2013.01)
USPC ..... 315/3.5; 216/13; 216/17; 216/18

(58) Field of Classification Search
None
See application file for complete search history.

(56) References Cited

U.S. PATENT DOCUMENTS

| | | | | |
|---|---|---|---|---|
| 2,880,355 | A | 3/1959 | Epsztein | |
| 3,860,880 | A * | 1/1975 | Yariv et al. | 330/5 |
| 5,488,380 | A * | 1/1996 | Harvey et al. | 342/368 |
| 7,825,440 | B1 * | 11/2010 | Choudhury | 257/275 |
| 7,999,440 | B2 * | 8/2011 | Miller et al. | 310/324 |
| 2003/0201851 | A1 * | 10/2003 | Yoshida et al. | 333/246 |
| 2005/0077973 | A1 | 4/2005 | Dayton, Jr. | |

FOREIGN PATENT DOCUMENTS

WO WO 2004107382 12/2004

OTHER PUBLICATIONS

Ives et al., "Development of Backward Wave Oscillators for Terahertz Applications", Thirteenth International Symposium on Space Terahertz Technology, Harvard University, 10 pages, Mar. 2002.
Grow et al., "Backward-Wave Oscillator Efficiency", Proceedings of the Ire, 9 pages, Jul. 1955.
"Simulation of 650 GHz Backward Wave Oscillators", Computer Simulation Technology, 5 pages, Dec. 3, 2009, http://www.cst.com/Content/Applications/Article/Simulation+of+650+GHz+Backward+Wave+Oscillators.

* cited by examiner

*Primary Examiner* — Douglas W Owens
*Assistant Examiner* — Dedei K Hammond
(74) *Attorney, Agent, or Firm* — Fulbright & Jaworski LLP

(57) ABSTRACT

A traveling wave device includes a slow wave circuit supported by a dielectric membrane. The dielectric membrane can have a thickness substantially smaller than a wavelength of operation of the traveling wave device.

17 Claims, 5 Drawing Sheets

TRAVELING WAVE ELECTRON DEVICE WITH MEMBRANE-SUPPORTED SLOW WAVE CIRCUIT

This application claims the benefit of U.S. Provisional Patent Application Ser. No. 61/293,580, filed on Jan. 8, 2010, and having the same title as the present application, and which is herein incorporated by reference.

FIELD

The present application relates to traveling wave electron devices.

BACKGROUND

Traveling wave electron devices include examples such as backward wave oscillators and traveling wave tube amplifiers. While traveling wave electron devices have been used successfully in the microwave region (e.g., 3 GHz to 300 GHz), devices operating at frequencies above about 100 GHz have been difficult to obtain. As the frequency of operation goes up, many dimensions of the device must be reduced. Results obtained from simple scaling of device dimensions are generally poor, as the performance of scaled devices drops rapidly as frequency is increased. Moreover, numerous fabrication challenges are presented as frequency is increased. Accordingly, traveling wave electron devices have not generally been considered a viable solution for generating or amplifying radiation in the THz range.

SUMMARY

In some embodiments of the invention a traveling wave device is provided. The device can include a vacuum enclosure and an electron beam source disposed within the vacuum enclosure. A slow wave circuit can also be disposed within the vacuum enclosure and positioned proximate to the electron beam source. A dielectric membrane can support the slow wave circuit. The thickness of the dielectric membrane can be substantially smaller than a wavelength of operation for the device.

In other embodiments of the invention, a method of making a traveling wave device is provided. The method can include obtaining a substrate. A dielectric layer can be deposited on the first side of the substrate. The second side of the substrate can be etched to expose a suspended portion of the dielectric layer. A slow wave circuit can be formed on the suspended portion of the dielectric layer. The method can also include assembling the substrate and an electron beam source into a vacuum enclosure to form the traveling wave device.

In other embodiments of the invention, a method of operating a traveling wave device is provided. The traveling wave device can include a slow wave circuit disposed on a suspended membrane. Operation can include emitting an electron beam within the traveling wave electron device. The electron beam can be coupled to the slow wave circuit to transfer energy from the electron beam to the slow wave circuit. Operation can also include extracting radiation from the traveling wave electron device. The radiation can have a frequency between about 300 GHz and about 2 THz.

BRIEF DESCRIPTION OF THE DRAWINGS

Additional features and advantages of the invention will be apparent from the detailed description that follows, taken in conjunction with the accompanying drawings, that together illustrate, by way of example, features of the invention; and, wherein.

DETAILED DESCRIPTION

Figure 1:
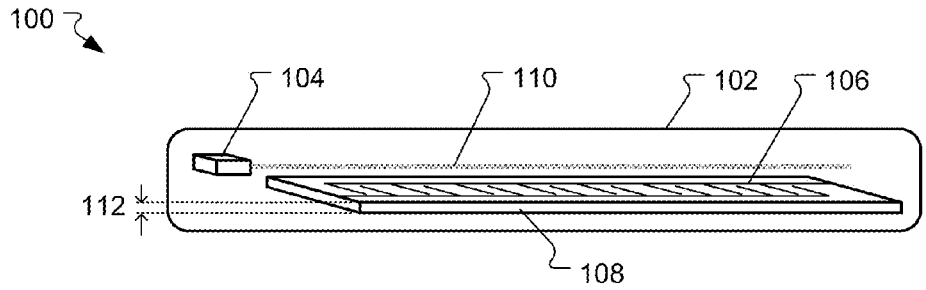
FIG. 1 is a schematic side view illustration of a traveling wave electron device in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to an item includes reference to one or more of such items.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items.

As used herein, the term "alternatively" refers to selection of one of two or more alternatives, and is not intended to limit the selection to only those listed alternatives or to only one of those listed alternatives at a time unless the context clearly indicates otherwise.

Traveling wave electron devices use coupling between an electron beam and a slow wave circuit to allow energy from the electron beam to be converted into energy within a mode propagating along the slow wave circuit. A traveling wave electron device can be configured to provide an amplifier, where an input signal propagating in a forward mode in the slow wave circuit extracts energy from the electron beam to produce a higher power output signal from the slow wave circuit. A traveling wave electron device can also be configured to provide a backward wave oscillator, where feedback between a reverse mode in the slow wave circuit and the electron beam results in an oscillating signal that can be coupled out of the device.

As introduced above, merely scaling a traveling wave electron device's dimensions to higher frequencies generally provides inferior performance results. For example, as dimensions are scaled down, electron beam size is also scaled down, which results in reduced efficiency and power output. Attempts to increase beam current density are constrained by practical limitations in obtainable magnetic field density. Surface effects limit the ability to place significant energy of the electron beam close to conductive materials, such as the slow wave circuit. Moreover, as the dimensions of the electron beam and slow wave circuit are reduced, coupling between the electron beam and the mode propagating along the slow wave circuit is reduced, further reducing efficiency and output power. In particular, at sufficiently small wavelengths, the electric fields of the modes traveling in the slow wave circuit cannot completely overlap the electron beam. This results in reduced coupling between the electron beam and modes propagating in the slow wave circuit. This coupling can be described in terms of interaction impedance (where higher interaction impedance corresponds to higher coupling). The present inventors have developed techniques to increase the interaction impedance applicable to the design and operation of traveling wave electron devices in the THz or sub-millimeter range. In particular, as discussed in further detail below, increased interaction impedance can be obtained by supporting the slow wave circuit on a thin dielectric membrane.

Scaling dimensions of traveling wave electron device also presents numerous fabrication challenges. Fabrication techniques used to produce structures with millimeter scale features do not scale to produce structures with micrometer scale features. Some material properties do not scale with dimension or frequency as would be desired. As described in further detail, the present inventors have developed techniques applicable to making traveling wave electron devices for operation in the THz or sub-millimeter range, or as a specific example, in the range of about 300 GHz to about 2 THz.

Turning to FIG. 1, a traveling wave electron device is illustrated in accordance with some embodiments of the present invention. The traveling wave electron device 100 can include a vacuum enclosure 102 in which an electron beam source 104 and slow wave circuit 106 are disposed. The slow wave circuit can be supported by a dielectric membrane 108. The slow wave circuit is proximate to the electron beam source so that e-field coupling between an electron beam 110 emitted from the electron beam source and the slow wave circuit can occur. The dielectric membrane can be relatively thin. For example, the dielectric membrane can have thickness 112 of about 1 micrometer, although other thickness lesser or greater than this example can be used. As additional examples, the dielectric membrane can have a thickness less than 1 micrometer, in the range of about 1 micrometer to about 5 micrometers, and other dimensions. In general, the thickness of the dielectric membrane can be much less than the free-space wavelength at the operating frequency of the device, for example, less than one tenth the free-space wavelength at the operating frequency, or less than one hundredth the free-space wavelength at the operating frequency.

The use of a thin dielectric membrane 108 can provide improved coupling between the electron beam 110 and the slow wave circuit 106. For example, coupling between the electron beam and a mode propagating within the slow wave circuit is a function of, among other things, the amount of overlap between the electron beam and the evanescent electric field of the mode propagating within the slow wave circuit. As the wavelength of operation decreases, the spatial extent of the evanescent field becomes smaller. Accordingly, at sub-millimeter wavelengths of operation, it is not generally possible to provide for complete overlap of the electron beam and the evanescent fields. Furthermore, the evanescent field tends to be concentrated inside any dielectric adjacent to the slow wave circuit. For example, in conventional traveling wave electron devices where a slow wave circuit is built on top of a dielectric block, the evanescent field tends to be confined primarily within the dielectric block, unable to efficiently interact with the electron beam.

The use of dielectric membrane 108 allows for a greater extent of the evanescent field. For example, for a sufficiently thin dielectric membrane, the evanescent electron field can be substantially symmetrically distributed above and below the slow wave circuit 106. In other words, the evanescent electric fields of the slow wave circuit can extend substantially equidistantly on both sides of the slow wave circuit. The greater extent of the field allows for a significant increase in the interaction impedance. This in turn, allows for greater efficiency, power output, or both to be obtained using the presently disclosed techniques.

Figure 2:
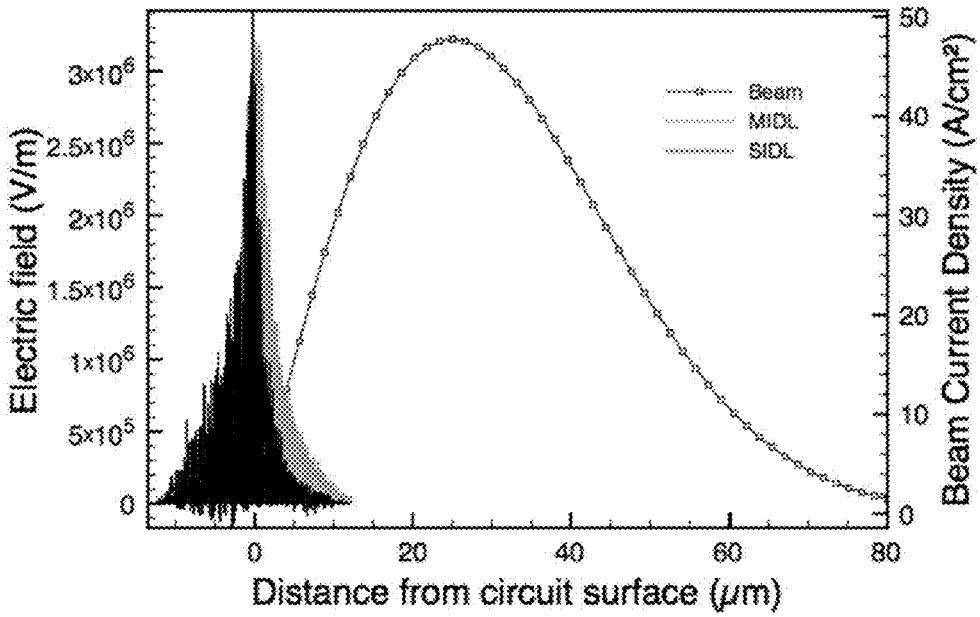
FIG. 2 is a graph showing overlap between the electric field and electron beam current density for a substrate supported interdigital line and a membrane supported interdigital line in accordance with some embodiments of the present invention.

FIG. 2 provides a graph that provides insight into how the coupling between the electron beam and the electric field within the slow wave circuit is enhanced by the use of thin dielectric membrane support. The electron beam current density (Amperes per centimeter-squared) is shown by the curve with square boxes (note that the horizontal axis is not to scale for the electron beam current density). Also shown is the distribution of the electric field (Volts/meter) versus horizontal distance relative to the surface of the slow wave circuit. Distributions are shown for two different embodiments of the slow wave circuit. Shown in dark grey is a conventional interdigital line disposed on an etched substrate. Shown in light grey is an interdigital line supported by a dielectric membrane. It can be seen that the distribution for the interdigital line supported by the dielectric membrane is shifted toward the right, and thus has greater overlap with the electron beam. This greater overlap can result in an increase in the interaction impedance of the structure (greater coupling), which can provide for greater operating efficiency.

The slow wave circuit can be constructed to support waveguide modes for the frequency range of interest. Various types of slow wave circuits 106 can be used. In general, the slow wave circuit comprises a geometrically periodic structure. For example, the slow wave circuit can be an interdigital line, as illustrated in FIG. 1. As additional examples, the slow wave circuit can be a serpentine waveguide, helical waveguide, vanes, or other structures.

Figure 3A:
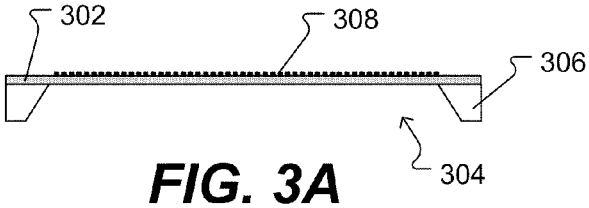
FIG. 3A is a side cross section view of a membrane supported interdigital line in accordance with some embodiments of the present invention.
Figure 3B:
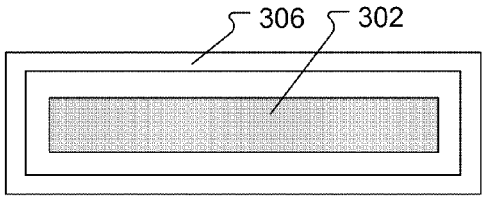
FIG. 3B is a bottom view of the membrane supported interdigital line of FIG. 3A.
Figure 4A:
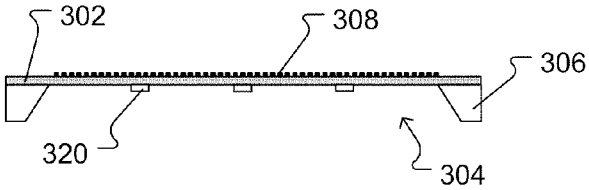
FIG. 4A is a side cross section view of another membrane supported interdigital line in accordance with some embodiments of the present invention.
Figure 4B:
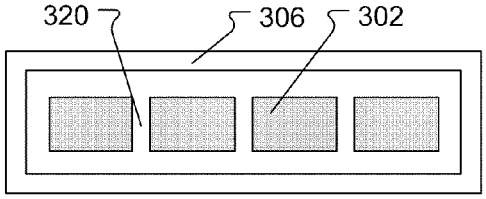
FIG. 4B is a bottom view of the membrane supported interdigital line of FIG. 4A.

Various types of dielectric membranes 108 can be used in the device. For example, FIGS. 3A-3B illustrates a dielectric membrane 302 which is suspended over a hole 304 in a substrate 306. The slow wave circuit 308 can be disposed on top of the dielectric membrane. If desired, as shown in FIGS. 4A-4B, ribs, beams, or other structural members 320 can be provided for additional support of the suspended portions of the dielectric layer. For example, structural members can be formed by patterning a mask through which the substrate is etched, as described in further detail below.

The traveling wave electron device can operate in a frequency range of about 300 GHz to about 2 THz, although other ranges, including ranges extending above and below this range can be used. The traveling wave electron device can be used as a traveling wave tube amplifier or a backward wave oscillator. For example, in an amplifier, THz energy can be injected into the slow wave circuit at one end, and an amplified signal extracted from the slow wave circuit at the other end. As another example, in an oscillator, the slow wave circuit can be terminated at one end, and oscillatory THz energy extracted from the other end.

Figure 5:
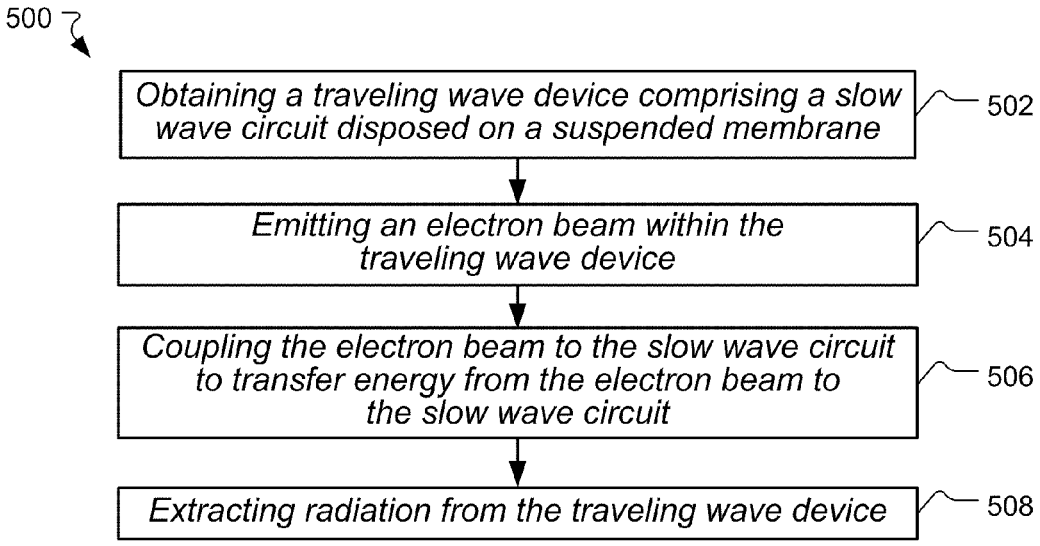
FIG. 5 is a flow chart of a method of operating a traveling wave electron device in accordance with some embodiments of the present invention.

In general, operation of a traveling wave electron device, such as traveling wave electron device 100, can include the operations illustrated in flow chart in FIG. 5. A first operation in the method 500 can be obtaining 502 a traveling a wave device comprising a slow wave circuit disposed on a suspended membrane. For example, the traveling wave electron device can be manufactured according to a process described further below. As another example, the traveling wave electron device can be purchased. For example, the traveling wave electron device can be manufactured to particular specifications, such as, for example, a particular frequency range of operation, particular output power level, etc.

The method 500 can include 504 emitting an electron beam within the traveling wave electron device. For example, the traveling wave electron device can include a thermionic emitter (e.g., a cathode) which emits electrons in a beam. Alternatively, other types of emitters can be used, including for example, field emitters. The traveling wave electron device can include magnets to shape and confine the beam. Other techniques and components for shaping and confining the beam can be used as well, including for example, electrostatic confinement. The beam can travel proximate to the slow wave circuit. The traveling wave electron device can include an absorber to absorb electrons. For example, the absorber (not shown) can be disposed near an end of the slow wave circuit furthest away from the electron beam source. The absorber can collect electrons after they have interacted with the slow wave circuit The method 500 can include coupling 506 the electron beam to the slow wave circuit to transfer energy from the electron beam to the slow wave circuit. For example, the coupling can be between the electron beam and the fields of a mode propagating within the slow wave circuit. As discussed above, this coupling can be enhanced due to the thin dielectric membrane. The velocity of the beam (e.g., determined by voltage used to accelerate the electrons within the beam) can be adjusted to match the propagation velocity of the desired mode within the slow wave circuit.

The method 500 can also include extracting 508 radiation from the traveling wave electron device. For example, the radiation can have a frequency between about 300 GHz and about 2 THz. The radiation can be extracted from the end of the slow wave circuit proximate to the electron beam source (e.g., in a backward wave oscillator). As another example, the radiation can be extracted from the other end of the slow wave circuit furthest away from the electron beam source (e.g., in a traveling wave tube amplifier). Extracting can be provided by a slot antenna, horn antenna, photonic crystal array, or other features.

Various ways of making a traveling wave electron device can be used. Microfabrication techniques can be used to provide fine scale structures having dimensions suitable for operation in the THz range. For example, techniques used in fabricating semiconductor devices and micro-electro-mechanical systems can be applied.

Figure 6:
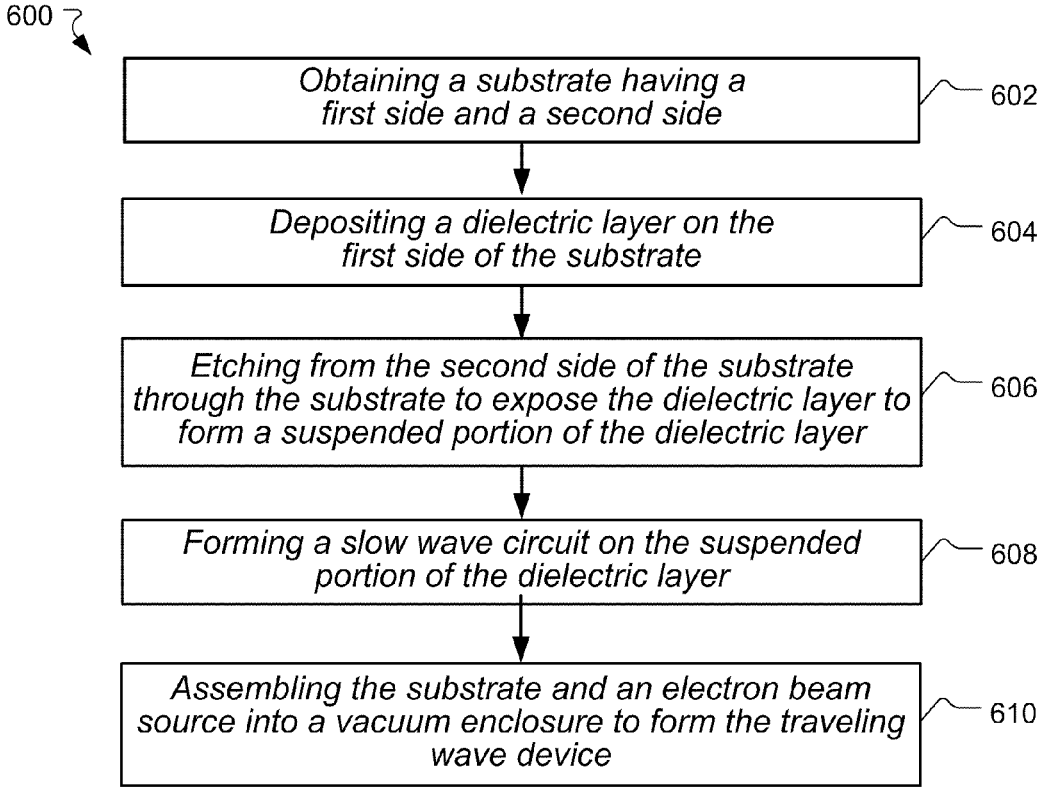
FIG. 6 is a flow chart of a method of making a traveling wave electron device in accordance with some embodiments of the present invention.
Figure 7A:
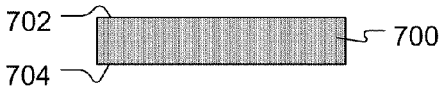
FIGS. 7A-7F are end-view illustrations of various operations in making a traveling wave electron device in accordance with some embodiments of the present invention.

A method of making a traveling wave electron device is show in flow chart form in FIG. 6, and examples of device in various stages of fabrication are illustrated in FIGS. 7A-7F. The method 600 can include, at 602, obtaining a substrate 700 (FIG. 7A). For example the substrate can be a silicon wafer. The silicon wafer can be cut and polished from a grown crystal, or obtained from a distributor of silicon wafers. Alternatively, other materials can be used for the substrate, including for example, other semiconductor materials, quartz, etc. The substrate 700 can include a first side 702 and a second side 704.

Figure 7D:
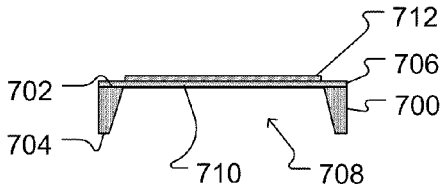
Figure 7B:
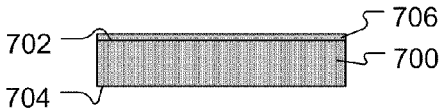
Figure 7E:
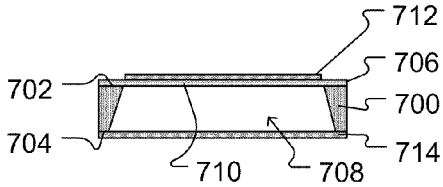

Another operation in the method 600 can be, at 604, depositing a dielectric layer 706 on the first side 702 of the substrate (FIG. 7B). For example, a silicon nitride layer can be grown on the first side of the substrate to form the dielectric layer. Alternatively, other materials can be used for dielectric material and grown or deposited onto the substrate.

Figure 7C:
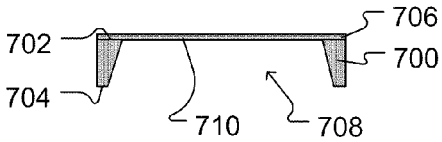
Figure 7F:
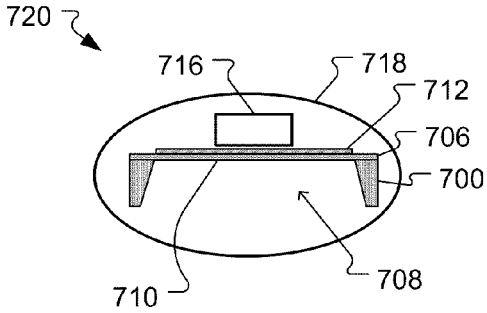

The method can include, at 606, etching 606 the substrate 700 to remove portions of the substrate. The substrate can be etched completely through from the second side 704 to form a hole 708 over which a suspended portion 710 of the dielectric layer 706 is suspended (FIG. 7C). For example, etching can include depositing a mask layer (not shown) on the second side 704 of the substrate and patterning the mask layer to define an opening (not shown). Various ways of etching can be used. For example, etching of the substrate can be performed through the opening. Etching can use anisotropic etching (e.g., KOH etching of silicon) to remove desired portions of the substrate. As a result of the etching, the suspended portion of the dielectric layer can be suspended over a hole in the substrate and held by remaining portions of the substrate 700. If desired, the mask can provide for ribs, beams, or other structural members (not shown) as described above to provide support of the suspended portions of the dielectric layer. Alternatively, the dielectric layer can be formed separately from the substrate and attached to the substrate before or after the hole is made.

At 608, another operation in the method is forming a slow wave circuit 712. The slow wave circuit can be formed on the suspended portion 710 of the dielectric layer 706 (FIG. 7D). Various ways of forming the slow wave circuit can be used. For example, the slow wave circuit can be formed by depositing a metal layer (not shown) on the dielectric layer and patterning the metal layer to define the slow wave circuit. Forming the slow wave circuit can occur either before or after the etching to remove portions of the substrate. As another example, the slow wave circuit can be formed on a dielectric layer which is then later attached to a substrate.

The slow wave circuit 712 is shown on the side 722 of dielectric layer 706 opposite the first side 702 of the substrate, although this is not essential. For example, the slow wave circuit can alternatively be disposed on the other side 724 of the dielectric layer, the side adjacent to the first side of the substrate. In such a case, the slow wave circuit can be formed after etching the substrate. Alternatively, the slow wave circuit can be deposited on the substrate before depositing the dielectric membrane, and the dielectric membrane deposited over the slow wave circuit. The slow wave circuit can then exposed by etching the substrate.

As discussed above, various types of slow wave circuits can be used. The slow wave circuit can be configured to provide a desired propagation velocity. The slow wave circuit can be a periodic structure. A sufficient number of periods in the slow wave circuit can be provided to provide for electronic gain of a mode propagating within the slow wave circuit.

If desired, the substrate 700 can be attached to a carrier 714. The carrier can help to strengthen the substrate.

The finished device 720 is assembled, at 610. The substrate 700 (with slow wave circuit 712 supported by the dielectric membrane 706) and an electron beam 716 source can be placed into a vacuum enclosure 718. In particular, electron beam source can be positioned with respect to the substrate to ensure that the electron beam grazes the surface of the substrate. For example, if the beam is too far away from the substrate, poor coupling efficiency can be obtained. Conversely, if the beam is too close, excessive heating of the slow wave circuit can occur.

Various materials can be used for the traveling wave electron device 700. For example, the vacuum enclosure 718 can comprises glass, metal, ceramic, and combinations thereof or other materials. As one example, the vacuum enclosure can be formed from stainless steel and can include one or more silicon windows (e.g., intrinsic silicon) for insertion or extraction of radiation into or out of the device. The slow wave circuit 712 can be formed using an electrically conductive material, including for example, metals such as aluminum and gold or other materials. The substrate can be silicon, gallium, diamond, graphite, ceramic, or other materials. The dielectric membrane can be silicon compounds (e.g. silicon nitride, silicon carbide), diamond, gallium or other materials.

While examples of particular methods of making a traveling wave electron device have been disclosed, a traveling wave electron device can be made using other techniques than those disclosed above. Conversely, the method of making a traveling wave electron device discussed above can be used to make other, different devices.

Figure 3C:
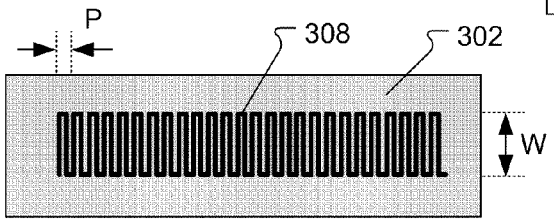
FIG. 3C is a top view of the membrane supported interdigital line of FIGS. 3A-3B.
Figure 8:
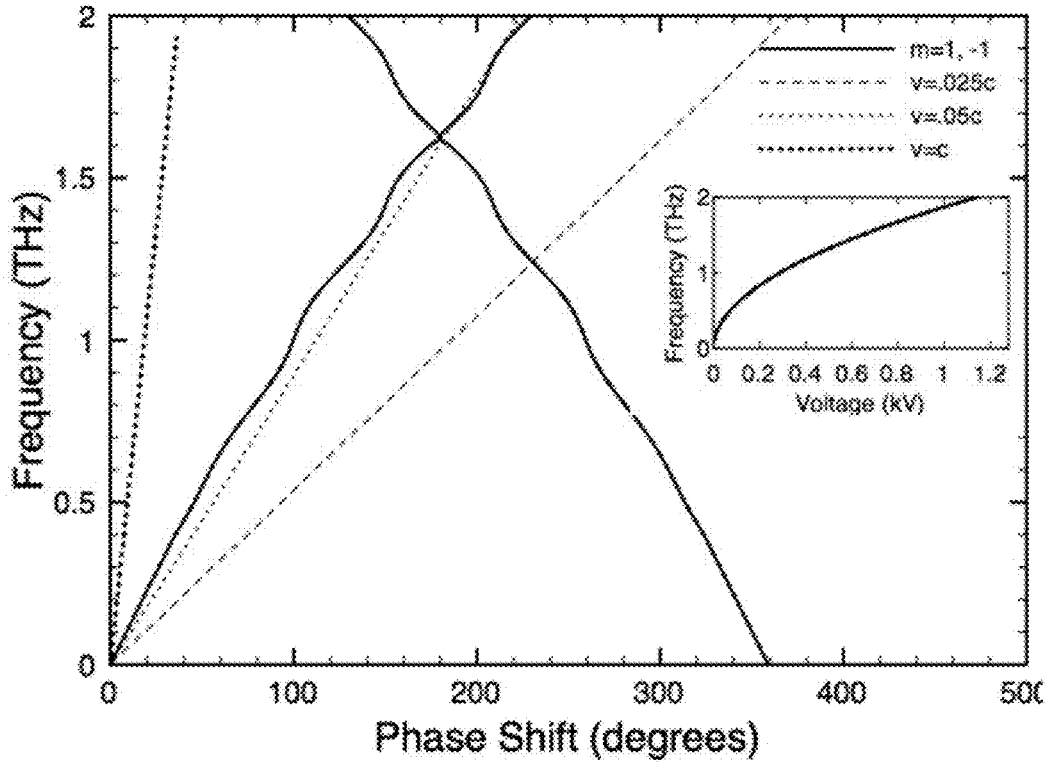
FIG. 8 is a graph showing electronic parameters of a traveling wave device in accordance with some embodiments of the present invention.

An example device for operation at 1 THz with now be described. The device can use the configuration shown in FIGS. 3A-3C. A silicon nitride membrane of about 1 micrometer thickness can support an interdigital line having a period (P) of about 10 micrometers and a width (W) of about 27.5 micrometers. A total of 1500 periods can be used. When operating the beam voltage at 650 Volts, the calculated distributions can be as shown in FIG. 2. By varying beam voltage between about 200 V to about 1000 V, operation from about 0.8 THz to about 1.6 THz can potentially be obtained. Calculated beam current can be about 10 milliamperes, resulting in a beam power of about 6.4 W. FIG. 8 illustrates dispersion curves for the first forward (m=1) and first backward (m=−1) modes of the interdigital circuit, the electron beam dispersion at speed of light (v=c), 0.025 times the speed of light (v=0.025c) and 0.05 times the speed of light (v=0.05c). The inset shows the frequency output as a function of the beam voltage.

While several illustrative applications have been described, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

What is claimed is:

1. A traveling wave device comprising:
- a vacuum enclosure;
- an electron beam source disposed within the vacuum enclosure;
- a slow wave circuit disposed within the vacuum enclosure and proximate to the electron beam source to enable electric field coupling between an electron beam emitted from the electron beam source and a mode propagating within the slow wave circuit; and
- a dielectric membrane supporting the slow wave circuit, wherein thickness of the dielectric membrane is substantially smaller than a wavelength of operation for the traveling wave device.

2. The device of claim 1, wherein the slow wave circuit is an interdigital line.

3. The device of claim 1, further comprising a substrate having a hole, wherein the dielectric membrane is suspended over the hole.

4. The device of claim 3, wherein:
- the substrate comprises silicon;
- the dielectric membrane comprises silicon nitride; and
- the slow wave circuit comprises aluminum.

5. The device of claim 1, wherein the dielectric membrane has a thickness of about 1 micrometer.

6. The device of claim 1, wherein the slow wave circuit supports modes having a frequency between about 300 GHz and about 2 THz.

7. The device of claim 1, wherein the device is a backward wave oscillator.

8. The device of claim 1, wherein the device is a traveling wave tube amplifier.

9. A method of making a traveling wave device comprising:
- obtaining a substrate having a first side and a second side;
- depositing a dielectric layer on the first side of the substrate;
- etching from the second side of the substrate through the substrate to expose the dielectric layer to form a suspended portion of the dielectric layer;
- forming a slow wave circuit on the suspended portion of the dielectric layer, wherein the forming comprises:
  - depositing a metal layer on the substrate; and
  - patterning the metal layer to define the slow wave circuit; and assembling the substrate and an electron beam source into a vacuum enclosure to form the traveling wave device.

10. The method of claim 9, wherein the slow wave circuit is an interdigital line.

11. The method of claim 9, wherein the slow wave circuit is formed on a side of the dielectric layer opposite the first side of the substrate.

12. The method of claim 9, further comprising attaching the substrate to a carrier.

13. The method of claim 9, wherein:

the substrate comprises silicon;

the dielectric material comprises silicon nitride; and the slow wave circuit comprises aluminum.

14. The method of claim 9, wherein the suspended portion of the dielectric layer has a thickness of about one micrometer.

15. The method of claim 9, wherein the slow wave circuit supports waveguide modes for frequencies between about 300 GHz and about 2 THz.

16. A method of making a traveling wave device comprising:

obtaining a substrate having a first side and a second side;

depositing a dielectric layer on the first side of the substrate;

etching from the second side of the substrate through the substrate to expose the dielectric layer to form a suspended portion of the dielectric layer; wherein the etching comprises:

depositing a mask layer on the second side of the substrate; and patterning the mask layer to define an opening through which the etching is performed;

forming a slow wave circuit on the suspended portion of the dielectric layer; and assembling the substrate and an electron beam source into a vacuum enclosure to form the traveling wave device.

17. A method of operating a traveling wave device comprising:

obtaining a traveling wave device comprising a slow wave circuit disposed on a suspended membrane;

emitting an electron beam within the traveling wave device;

coupling the electron beam to the slow wave circuit to transfer energy from the electron beam to the slow wave circuit; and extracting radiation from the traveling wave device, wherein the radiation has a frequency between about 300 GHz and about 2 THz, and wherein evanescent electric fields of the slow wave circuit extend substantially equidistantly on both sides of the slow wave circuit.

* * * * *